US010220502B2

(12) United States Patent
Bradley

(10) Patent No.: US 10,220,502 B2
(45) Date of Patent: Mar. 5, 2019

(54) ANGLE STOP COMBINATION AND TOOL HANDLE

(71) Applicant: Theodore Bradley, North Ridgeville, OH (US)

(72) Inventor: Theodore Bradley, North Ridgeville, OH (US)

(73) Assignee: MAGNA INDUSTRIES, INC., Cleveland, OH (US)

( * ) Notice: Subject to any disclaimer, the term of this patent is extended or adjusted under 35 U.S.C. 154(b) by 101 days.

(21) Appl. No.: 14/940,869

(22) Filed: Nov. 13, 2015

(65) Prior Publication Data

US 2016/0136802 A1 May 19, 2016

Related U.S. Application Data

(60) Provisional application No. 62/079,049, filed on Nov. 13, 2014.

(51) Int. Cl.
*B25G 1/08* (2006.01)
*B25B 13/48* (2006.01)
*B25B 13/56* (2006.01)

(52) U.S. Cl.
CPC ..... *B25G 1/085* (2013.01)

(58) Field of Classification Search
CPC ..... B25G 1/085
USPC ..... 81/176.1
See application file for complete search history.

(56) References Cited

U.S. PATENT DOCUMENTS 759,948 A * 5/1904 Weston ..... B25B 13/08 81/125.1
D45,556 S * 4/1914 Gravier et al. ..... D8/17
D54,127 S * 11/1919 Roberts ..... D8/28
5,303,439 A 4/1994 Seals
5,305,667 A * 4/1994 Caballero ..... B25B 13/00 7/138
D422,875 S 4/2000 Beck
6,279,434 B1 * 8/2001 Brown ..... A63C 17/0006 81/177.4
6,435,065 B2 * 8/2002 Kozak ..... B25G 1/085 81/177.4
D462,245 S 9/2002 Freidman et al.
D468,987 S 1/2003 Dreyfus
6,523,440 B2 2/2003 Freidman et al.
6,739,224 B1 * 5/2004 Wershe ..... B25G 1/085 7/138
D517,892 S * 3/2006 Galyean ..... D8/17
7,305,907 B2 * 12/2007 Burwell ..... B25G 1/085 81/177.2
D618,076 S 6/2010 Garcia
D631,310 S 1/2011 Senyk
D651,056 S 12/2011 Robinson
(Continued)

*Primary Examiner* — Hadi Shakeri

(57) ABSTRACT

An angle stop wrench with an open first end sized for holding a plumbing component during an installation procedure. A side opening of a different size from the open first end is also included in the angle stop wrench for holding a plumbing component during the installation procedure. Finally, a hook end portion for holding and aligning a plumbing component during the installation procedure is also provided, where the hook portion is formed on an end portion spaced from the open first end portion. The angle stop wrench may be secured for storage within the handle of a second tool useful in the installation procedure.

4 Claims, 3 Drawing Sheets

(56) References Cited

U.S. PATENT DOCUMENTS

| | | | | |
|---|---|---|---|---|
| D651,880 | S | 1/2012 | Robinson | |
| D714,111 | S | 9/2014 | Robinson | |
| D716,121 | S | 10/2014 | Huang | |
| D716,622 | S | 11/2014 | Huang | |
| 2006/0048305 | A1* | 3/2006 | Giordano, III | B25D 1/045 7/143 |

* cited by examiner

ANGLE STOP COMBINATION AND TOOL HANDLE

CROSS REFERENCE TO RELATED APPLICATION

The present application claims priority from U.S. Provisional Application Ser. No. 62/079,049 filed Nov. 13, 2014, the entire subject matter of which is incorporated herein.

FIELD OF INVENTION

The present application is directed to a combination of hand tools, and more particularly to an angle stop wrench supported within the tool handle of a second tool useful in connection with installation of a compression valve.

BACKGROUND

Typical plumbing fixtures include a widely used fitting to connect a household water plumbing system with a plumbing fixture. Such fittings are referred to as compression stop or compression stop valves, or angle stop valves. Such compression stops are commonly used to terminate the plumbing water supply at a location near the fixture, such as a toilet or sink faucet, to shut off the water supply prior to the fixture to enable the fixture to be repaired or replaced without shutting down the whole plumbing system.

Unfortunately, due to the location of such angle stops, replacement of such compression fittings can be difficult. The location is awkward to reach, likely in a confined space, so that movement within the space is cramped and dark, and thus difficult. Additionally, the installation of such a compression fitting requires accurate alignment between the fixture and water supply in order to assure proper operation. Multiple wrenches are typically used to enable installation of the fitting, which can make an already difficult project even more cumbersome.

Numerous prior art tool devices have attempted to provide solutions to the situation described above, including U.S. Pat. Nos. 4,542,666 and 6,523,440.

SUMMARY

The present angle stop wrench is provided in combination with and stored within the handle of a second tool which may also be used in connection with installation of a plumbing compression fitting. Angle stop valves are easy to install using the angle stop wrench to hold the valve aligned in the desired position and the second tool to make the compression connection to the water supply line. The angle stop wrench includes openings which are useful with components having 0.5 or half inch diameters and 8/10 inch diameters, as well as an end portion to be secured within at least a 7/10 inch internal diameter opening.

The angle stop wrench is preferably stored within the handle of a second tool. Such storage may be accomplished using a magnet which may be secured either on the angle stop wrench or on or within the tool handle of the second tool. Alternatively, the angle stop wrench may be secured within a mating opening formed by a molded polymer handle portion, but where the mating opening has an internal dimension which is similar but slightly smaller than the overall external diameter of the angle stop wrench, such that the angle stop wrench may be slid, pressed or press fit into secure and captured engagement within the opening. Cap covers may also be provided on each of the tips of the second tool to avoid marring or other damage to the surface of the fitting during installation. The present device provides multiple advantages to the homeowner or plumber to accomplish a number of tasks.

DETAILED DESCRIPTION

Figure 1:
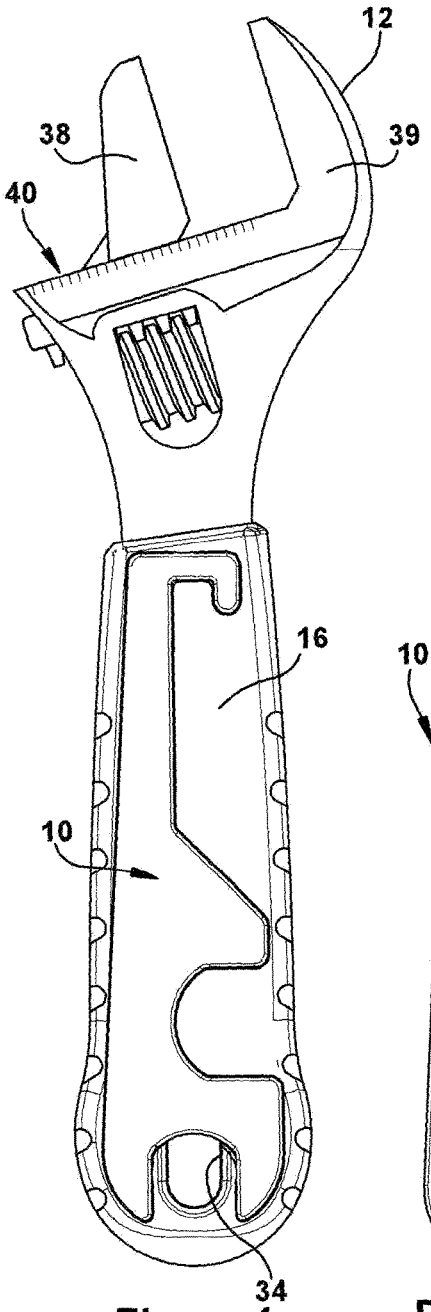
FIG. 1 is a top view of an angle stop wrench secured within a second tool handle.
Figure 2A:
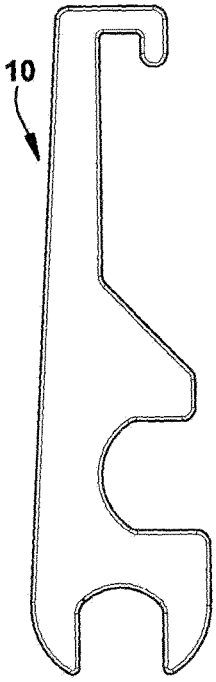
FIG. 2A is a top view of the angle stop wrench removed from the mating opening of the second tool handle of FIG. 2.
Figure 2:
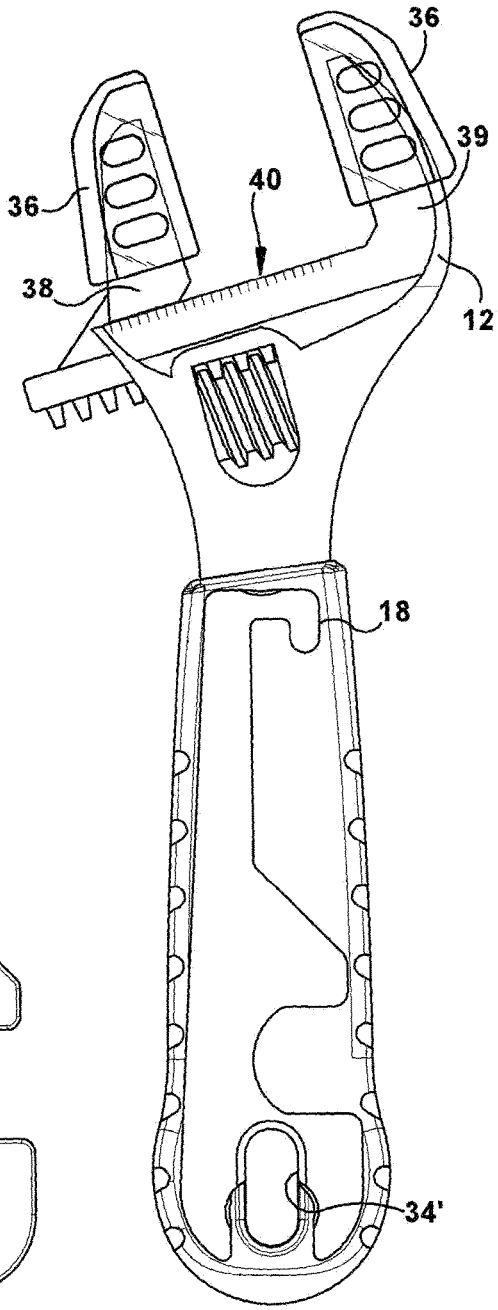
FIG. 2 is a top view of an alternate embodiment of the second tool shown in FIG. 1, where the molded rubber handle is configured with a mating opening to receive and capture the angle stop wrench within the handle of the second tool.
Figure 5:
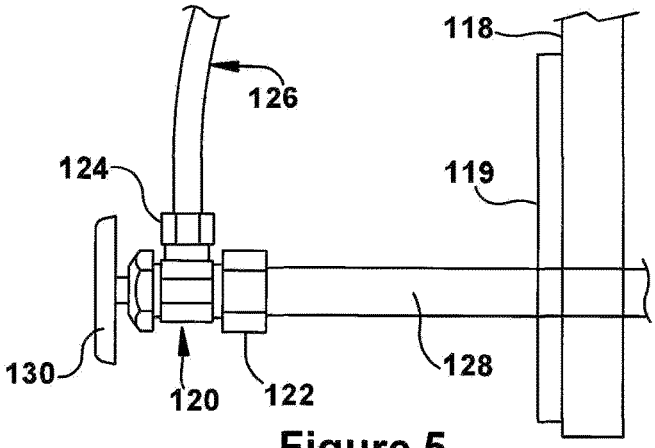
Figure 5 (Prior Art)
FIG. 5 is a view of the plumbing system environment where an angle stop compression valve and filling tubing are to be interconnected using the angle stop wrench and second tool of the present application.

The preferred angle stop wrench 10, of FIGS. 2A and 6 to 10, is provided in combination with and stored within the handle portion 14 of a second tool 12, of FIGS. 1 and 2, which is also used in connection with installation of a plumbing compression fitting. Angle stop valves 120 or compression fittings, of the type shown in FIG. 5, are easy to install using an angle stop wrench 10 to hold the valve 120 aligned in the desired position for attachment to a water supply line 128, which extends from a wall 118 through a cabinet 119. Once the valve 120 is in the desired aligned position, where the angle stop wrench 10 is used to steady and resist rotation, the appropriate openings in the wrench 10 are used to tighten a compression nut 124 using a conventional wrenching operation. The second tool 12 may also be used to make the compression connection to the water supply line 128 by tightening the primary nut 122. The FIGS. 2A, 7 and 8 angle stop wrench 10 includes two (2) openings 20, 22 which are useful with components having 0.5 or half inch and 8/10 inch diameters, respectively, as well as an end portion 24 for engagement within at least a 7/10 inch internal diameter opening, for example in the internal diameter of the compression nut 124, during alignment and prior to engagement of the riser tubing 126 which supplies water to the associated plumbing fixture, when the valve handle 130 is moved to an open position. The openings 20, 22 may have a U-shaped configuration, a hex configuration, or other internal configurations appropriate for engagement with standard plumbing nuts. The widest external dimension of the wrench 10 (preferably about 1 inch) is smaller than the external dimension of the second tool handle portion 14. It should be understood that where alternative embodiments of components having similar elements are discussed, the similar components or elements may be designated with the same reference numeral, but with a prime designation.

Figure 3:
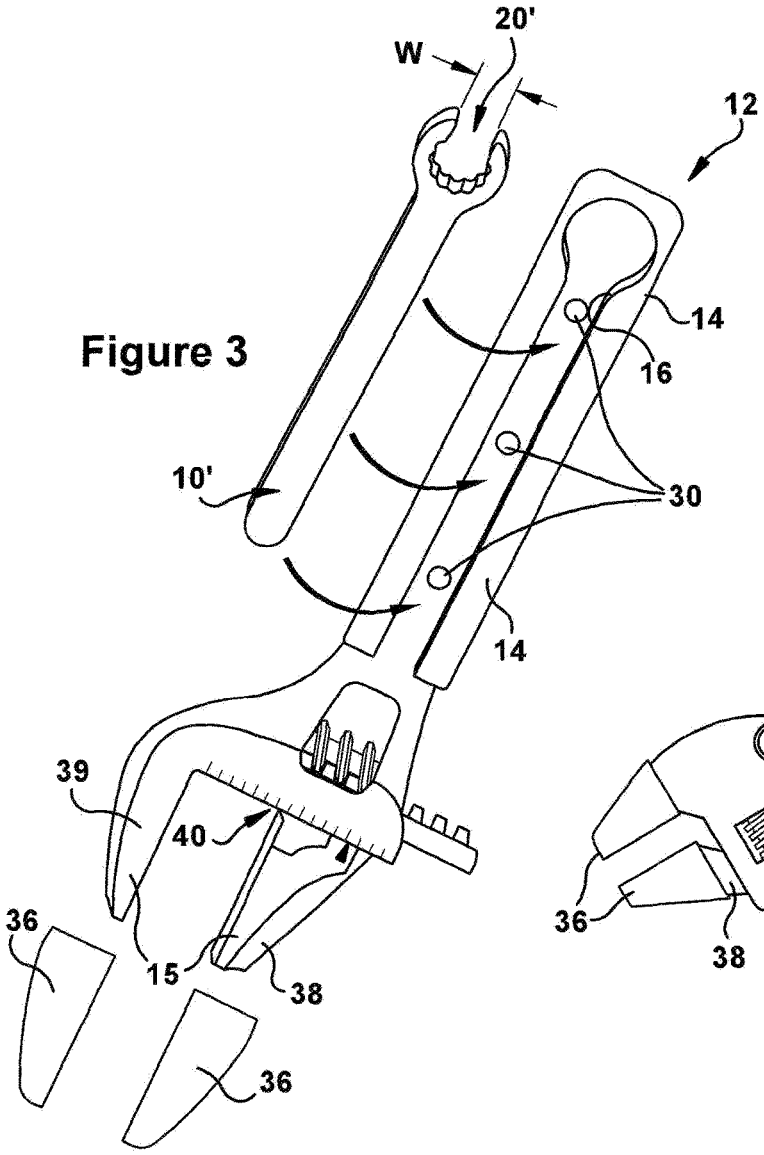
FIG. 3 is an exploded view of an alternate tool showing alternate embodiments of a removable wrench tool and showing the tip caps removed from the second tool.
Figure 4A:
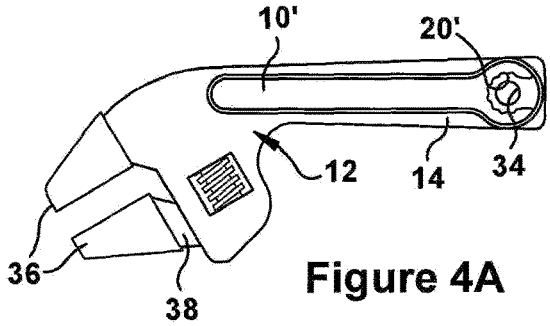
FIG. 4A is a top plan view of a wrench tool secured within the handle of a second tool.
Figure 4B:
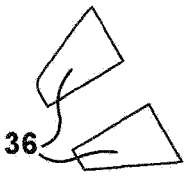
FIG. 4B is a top plan view showing the tip caps removed from the second tool of FIG. 4A.
Figure 4C:
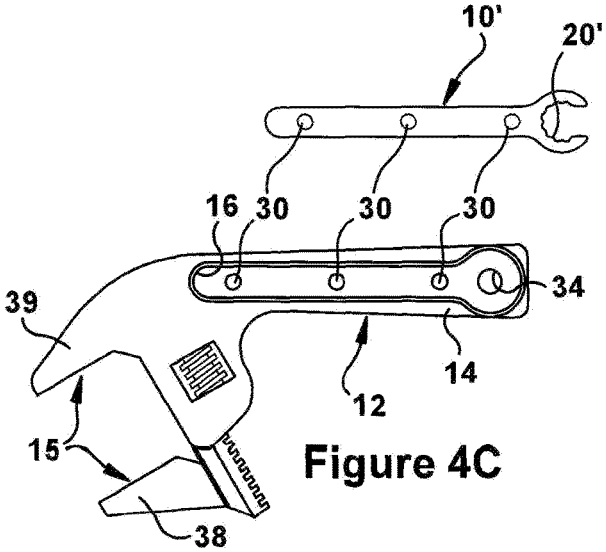
FIG. 4C is an exploded plan view of the wrench tool of FIG. 4A from engagement within the second tool handle, and showing the second tool having a magnet within the opening positioned for magnetically engaging the wrench tool, which may also include magnets.
Figure 6:
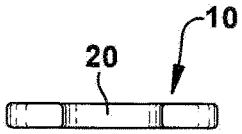
FIG. 6 is a top end view of the angle stop wrench of FIGS. 2A and 7.
Figure 7:
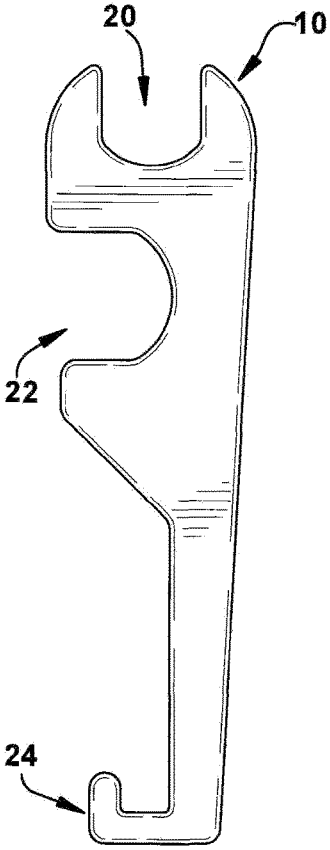
FIG. 7 is a top plan view of the angle stop wrench.
Figure 8:
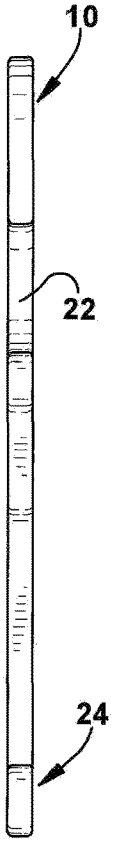
FIG. 8 is a rear plan view of the angle stop wrench of FIG. 7.
Figure 9:
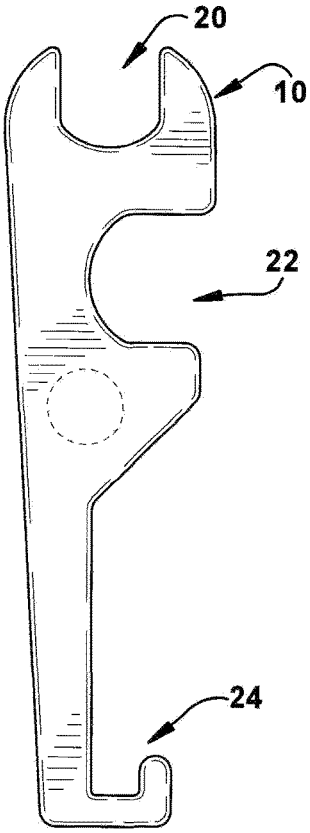
FIG. 9 is a left side view of the angle stop wrench of FIG. 7 and a right side view of the angle stop wrench of FIG. 8.
Figure 10:
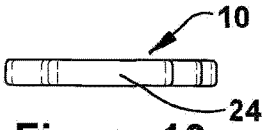
FIG. 10 is a bottom end view of the angle stop wrench of FIG. 8.

The angle stop wrench 10 is stored within the handle portion 14 of the second tool 12 using a variety of techniques. It should be understood that a variety of wrench configurations 10' may also be stored within the second tool 12, as shown in FIGS. 3 and 4A, but that the embodiment of the angle stop wrench 10 shown in FIGS. 2A and 7 is preferred. In the embodiment of wrench 10' shown in FIGS. 3 and 4, a single sized opening is provided which is sized with a width W for receiving standard water supply line attachments. In this embodiment, magnets 30 are used to secure the wrench 10' within the second tool 12. One or more magnets 30 may be secured either on the angle stop wrench 10, 10' and/or within the tool handle portion 14 of the second tool 12, as shown. The angle stop wrench is preferably of a magnetically attractive material, such as steel or nickel plated steel. The angle stop wrench may be formed as a stamping from a single piece of metal material. In the embodiments of FIGS. 3 and 4A and 4C, an opening 16 is provided within the second tool handle portion 14 having an internal dimension which is similar to that of the overall external configuration of the angle stop wrench 10', such that the angle stop wrench is fitted within the opening 16 and secured by magnetic engagement. As shown in the embodiment of FIG. 4B, magnets may also be secured to the wrench handle 14, to further ensure engagement of the wrench 10' within the second tool 12. The magnets 30 are secured within the handle portion 14 or wrench handle using standard adhesive materials, such as glue, or a press fit relationship, or both.

Alternatively, the angle stop wrench 10 may be secured for storage within a mating opening 18 formed by a handle portion 14 of a molded rubber polymer. In this embodiment, shown in FIG. 2, a mating opening 18 is provided which has an internal dimension which is similar to, but slightly smaller than, the external configuration of the angle stop wrench 10, such that the angle stop wrench may be slid, pressed or press fit into secure and captured engagement within the mating opening 18, taking advantage of the material characteristics of the molded rubber polymer handle portion 14. Still further, as in FIG. 1, an opening 16 in a molded polymer handle portion 14 of the second tool 12 which is sized slightly smaller than the overall external configuration of the angle stop wrench 10 may likewise be used to secure and capture the wrench within the opening. It should be understood that whether using magnets as in FIGS. 3 and 4B, or the handle portion of FIG. 1 or 2, the second tool handle portion 14 may include a sliding or slotted engagement between the wrench 10, 10' and the slot or opening 16, 18 formed in the second tool 12.

A finger opening 34, shown in FIG. 1, is provided through the handle portion 14 of the second tool 12, so that the angle stop wrench 10 may be pushed out of magnetic engagement and out of engagement with the opening 16, 18 in the tool handle by pushing a user's finger through the finger opening 34 to remove the angle stop wrench 10. Alternatively, the finger opening 34, shown in FIG. 2, may provide sufficient space for a user's finger to pry out the angle stop wrench 10 from the handle portion 14, but may not pass completely through the handle portion. Still further, the finger opening 34 may be used to hang the second tool during storage. In this embodiment, an alternate form of the second tool is provided as a conventional adjustable wrench.

Finally, in the embodiment of FIGS. 2, 3 and 4A, tip caps 36 are provided on each of the tips 15 of the second tool 12 to avoid marring or other damage to the surface of the plumbing fitting during installation. The tip caps 36 may be of any suitable non-marring material, such as flexible rubber or hard polymer material. Also in FIGS. 1 and 2, the external surface of the handle portion 14 for holding by the user is provided as a cushion grip material for comfort. Still further, the movable jaw 38 on the second tool 12 wrench may be reversed for holding pipe and other and larger pipe fittings, as shown in FIG. 4C. A ruler or measurement indications 40 are also provided on the fixed jaw 39 of the second tool 12 wrench in the illustration of FIGS. 1-3.

Although the exemplary embodiments have been described in detail with references and detail sufficient for one of ordinary skill in the art to practice the invention, it should be understood that various changes, substitutions and alterations may be made without departing from the spirit or scope of the device as defined in the attached claims. Moreover, the scope of the present device is not intended to be limited to the specific embodiments described here, which are provided by way of example. As one of ordinary skill in the art will readily appreciate from the disclosure of the present device and its embodiments, other components and means presently existing or later to be developed that perform substantially the same function to achieve substantially the same result as those of the corresponding embodiments described here, may be utilized according to the present application. Accordingly, the appended claims are intended to include within their scope such other components or means.

I claim:

1. A combination angle stop wrench removably secured within a top surface of a handle portion of a second adjustable wrench tool, the angle stop wrench having an open first end portion with a width capable of receiving a 0.5 inch sized plumbing component nut during an installation procedure, and wherein the widest external diameter of the open first end portion is approximately 1.0 inch, an open side portion of a size different from the open first end portion and with a width capable of receiving an 8/10 inch sized plumbing component nut during an installation procedure, and a hook portion for holding and aligning an internal diameter of a plumbing component during an installation procedure which hook portion is formed on a second end portion spaced from the open first end portion, and the external diameter of the hook portion is approximately 7/10 inch.

2. The combination tool of claim 1, wherein the angle stop wrench is removably secured within the second adjustable wrench tool by press fit engagement into a mating opening in the top surface of the handle portion, and the mating opening is sized slightly smaller than the external configuration of the angle stop wrench.

3. The combination tool of claim 1, wherein the angle stop wrench is formed of a magnetically attractive material and is removably secured within an opening in the top surface of the handle portion of a the second adjustable wrench tool by attraction to magnets attached within the handle portion of the second adjustable wrench tool.

4. A combination angle stop wrench and a second tool, wherein the angle stop wrench is removably secured within a top surface of a molded polymer handle portion of the second tool, the angle stop wrench having an open first end portion of a size for holding a 0.5 inch sized plumbing component during an installation procedure and the widest external diameter of the open first end portion is approximately 1 inch, an open side portion of a size for holding an 8/10 inch sized plumbing component during an installation procedure, and a hook portion formed on a second end portion spaced from the open first end portion is approximately 7/10 inches wide and is sized to be engaged within a plumbing component for holding and aligning an internal diameter of a plumbing component during an installation procedure, and wherein the angle stop wrench is secured partially covering a finger opening formed through the molded polymer handle portion of the second tool by engagement into a mating opening in the top surface of the handle portion sized slightly smaller than the external configuration of the angle stop wrench.

* * * * *